US008137507B2

(12) United States Patent
Ishino et al.

(10) Patent No.: US 8,137,507 B2
(45) Date of Patent: Mar. 20, 2012

(54) SHOE PRESS BELT FOR PAPER-MAKING MACHINE AND PROCESS FOR PRODUCING THE SAME

(75) Inventors: Atsushi Ishino, Tokyo (JP); Nobuharu Suzuki, Tokyo (JP); Shintaro Yamazaki, Tokyo (JP); Takeshi Sawada, Tokyo (JP); Tomoyuki Kawamata, Tokyo (JP)

(73) Assignee: Ichikawa Co., Ltd., Tokyo (JP)

( * ) Notice: Subject to any disclaimer, the term of this patent is extended or adjusted under 35 U.S.C. 154(b) by 28 days.

(21) Appl. No.: 12/666,660

(22) PCT Filed: Jun. 24, 2008

(86) PCT No.: PCT/JP2008/061430

§ 371 (c)(1),
(2), (4) Date: Dec. 24, 2009

(87) PCT Pub. No.: WO2009/001806

PCT Pub. Date: Dec. 31, 2008

(65) Prior Publication Data

US 2010/0186918 A1 Jul. 29, 2010

(30) Foreign Application Priority Data

Jun. 25, 2007 (JP) ..... 2007-166372

(51) Int. Cl.
*D21F 3/02* (2006.01)
*B29C 59/02* (2006.01)

(52) U.S. Cl. ..... 162/358.4; 162/358.2; 162/900; 162/901; 442/59; 442/101; 428/141; 428/212; 428/332; 264/293; 264/340

(58) Field of Classification Search ..... 162/358.3, 162/358.4, 900, 901; 428/141, 220, 332; 442/59, 101, 118, 148, 164; 264/239, 257, 258, 293, 340
See application file for complete search history.

(56) References Cited

U.S. PATENT DOCUMENTS

| | | | | |
|---|---|---|---|---|
| 4,482,430 | A | 11/1984 | Majaniemi | |
| 5,298,124 | A * | 3/1994 | Eklund et al. | 162/306 |
| 5,302,251 | A | 4/1994 | Schiel et al. | |
| 7,776,188 | B2 * | 8/2010 | Morton et al. | 162/358.4 |
| 2004/0040685 | A1 | 3/2004 | Watanabe | |
| 2005/0224318 | A1 * | 10/2005 | Hikida | 198/844.1 |
| 2006/0113052 | A1 | 6/2006 | Hikida et al. | |
| 2006/0207739 | A1 | 9/2006 | Takamura et al. | |
| 2006/0266489 | A1 | 11/2006 | Takamura | |
| 2007/0042851 | A1 * | 2/2007 | Gronych et al. | 474/237 |

FOREIGN PATENT DOCUMENTS

| | | |
|---|---|---|
| JP | 5 311592 | 11/1993 |
| JP | 6 81291 | 3/1994 |
| JP | 2004 84125 | 3/2004 |
| JP | 2006 152501 | 6/2006 |
| JP | 2006 257602 | 9/2006 |
| JP | 2006 336129 | 12/2006 |

OTHER PUBLICATIONS

U.S. Appl. No. 13/203,174, filed Aug. 24, 2011, Yamazaki.

* cited by examiner

*Primary Examiner* — Eric Hug
*Assistant Examiner* — Peter Chin
(74) *Attorney, Agent, or Firm* — Oblon, Spivak, McClelland, Maier & Neustadt, L.L.P.

(57) ABSTRACT

A shoe press belt for paper-making machine that reduces belt damages attributed to the friction between belt and shoe. The shoe press belt for paper-making machine having a wet paper contact surface and a shoe contact surface, is characterized in that the shoe press belt for paper-making machine has a base member and at least a polymer elastic part constituting the shoe contact surface and that the shoe contact surface of the polymer elastic part has a surface roughness (Ra) of 1.0 to 3.5 μm.

8 Claims, 6 Drawing Sheets

(a)

(b)

| Surface roughness of mandrel | Roughness at shoe side | Frictional resistance | | Comprehensive evaluation |
|---|---|---|---|---|
| | | Test 1: no lubricant | Test 2: lubricant used | |
| Ra (μm) | Ra (μm) | kg/cm$^2$ | kg/cm$^2$ | |
| 0.51 | 0.32 | 78 | 8 | Bad |
| 0.75 | 0.59 | 62 | 8 | Bad |
| 1.15 | 1.06 | 36 | 4 | Good |
| 2.11 | 1.97 | 29 | 3 | Good |
| 3.22 | 2.98 | 14 | 3 | Good |
| 3.89 | 3.60 | 16 | 6 | Slightly bad |
| 5.03 | 4.82 | 22 | 8 | Bad |

SHOE PRESS BELT FOR PAPER-MAKING MACHINE AND PROCESS FOR PRODUCING THE SAME

TECHNICAL FIELD

This invention relates to a belt utilized in a shoe press device, e.g. shoe presses for paper-making machine (which may hereinafter be referred to simply as belt) and more particularly, to a belt utilized in closed-type shoe presses.

BACKGROUND OF THE ART

For paper-making machines, shoe press devices, in which a press unit constituting of a press roll and a shoe, has been used ordinarily. Since the shoe press device is able to provide a planar press unit, inherent effects are shown at a variety of portions in paper-making processes in comparison with existing linear press parts composed of rolls themselves.

FIG. 1 shows a schematic view of a conventional shoe press device used in a press part. In a device of FIG. 1(*a*), a relatively elongated shoe press belt is used and in a device of FIG. 1(*b*), a relatively short shoe press belt is used.

The shoe press devices 100*a*, 100*b* of FIGS. 1(*a*) and (*b*) comprises a press unit P constituted of a press roll R and a shoe S, respectively. A pair of felts F, which sandwich wet paper W therebetween, and belt B are disposed in the press unit, and the rotation of the press roll R allows the wet paper W, felts F, F and belt B to run and pass through the press unit P.

It will be noted that arrow MD in the figures indicates the direction of rotation of the press roll R.

FIG. 2 shows a schematic view of a conventional shoe press device used in a calendar part.

A shoe press device 100*c* employed in the calendar part shown in FIG. 2 holds a belt BC for calendar and a rough surface paper W' as a paper material in a press unit P which is constituted of a calendar roll R' and a shoe S, and the rotation of the calendar roll R' allows the belt BC for calendar and the rough surface paper W' to pass through the press unit P.

It will be noted that arrow MD in the figure indicates the direction of rotation of the press roll R.

A belt B and a belt BC for calendar are used in the shoe press devices for the press part and the calendar part. The belt B and the belt BC for calendar differ in structure in details so that they show inherent effects at the respective parts. Nevertheless, they have a common fundamental structure composed of a base member for ensuring strength throughout the belt and a polymer elastic part disposed at the base member.

Meantime, even with the shoe press device in either part, it is common to be formed with means of supplying a lubricant to reduce a friction between shoe and belt. Liquid lubricant oil is used as the lubricant.

However, these shoe press devices are disadvantageous in that when a lubricant is supplied between the shoe and the belt in reduced amount, a shortage of the lubricant is apt to occur, thereby causing the belt to be damaged owing to the heat of friction.

The trouble of a lubricant supply device may lead to no supply of lubricant, which cause a breakage of the belt likewise.

To cope with this situation, many attempts have been proposed for supplying a large amount of a lubricant between the shoe and the belt with respect to the machine configuration of shoe press device. Further, many attempts have been proposed for supplying a larger amount of a lubricant into the press part also with respect to the belt configuration.

FIG. 3 shows a system of supplying a lubricant to a press part of a shoe press device disclosed in Patent Document 1.

FIG. 3(*a*) shows a lubricant supply device L, which is located at an upstream side along the direction of MD relative to a shoe S so as to supply a lubricant L1 between the shoe S and a shoe contact surface B12 of a belt B1.

This invention is characterized by providing a plurality of concave portions B13 for holding a lubricant in the surface of the shoe contact surface B12 of the belt B1. The belt B1 is run toward under nip pressure while keeping a lubricant by means of the concave portions B13, thus enabling the lubricant to be supplied between the shoe S and the belt B1.

In this Patent Document 1, a variety of configuration examples of concave portions are described, and for example, a cup-shaped concave portions B13 as shown in FIG. 3(*b*) and a grooved concave portions B13' as shown in FIG. 3(*c*) are disclosed.

On the other hand, FIG. 4 shows a belt disclosed in Patent Document 2. In this technique, a belt B2 is constituted of a base member consisting of MD yarns B24 and CMD yarns B25, which are laid one on another, and a polymer elastic part disposed on the base member. The belt B2 has a wet paper contact surface B21 and a shoe contact surface B22.

It is to be noted that the CMD indicates a direction vertical to the MD on the plane of the belt.

On the belt B2, convex portions 823 are formed at the shoe contact surface 822. These convex portions 23 allow concaves and convexes to be formed at the shoe contact surface B22. In this way, a lubricant is held at the shoe contact surface B22, thereby enabling the lubricant to be supplied between the shoe and the belt B2.

Further, FIG. 5 shows a belt disclosed in Patent Document 3. This belt 10 has a wet paper contact surface 11 and a shoe contact surface 12 at a base member 20 wherein fine irregularities are formed at the shoe contact surface 12 by means of a powder 40 contained in a polymer elastic part 30. A lubricant is held in these fine irregularities, so that a friction between the shoe and the belt is mitigated.

Patent Document 1: U.S. Pat. No. 4,482,430
Patent Document 2: JP, A 06-81291
Patent Document 3: JP, A 2004-84125

DISCLOSURE OF INVENTION

Problems to be Solved by the Invention

Recently, use of a higher shoe press pressure and a higher machine speed has been applied, and the problem that the belt is damaged owing to the shortage of a lubricant supplied to the contact surfaces of the shoe and the belt has become more serious.

The present invention intends to provide a shoe press belt for paper-making machine capable of supplying a sufficient amount of lubricant between belt and shoe.

Means for Solving the Problems

The invention has solved the above problem by providing a shoe press belt for paper-making machine having a wet paper contact surface and a shoe contact surface, characterized in that said shoe press belt for paper-making machine comprises a base member, and a polymer elastic part constituting at least said shoe contact surface, wherein a surface roughness of the shoe contact surface of the polymer elastic part is Ra=1.0 to 3.5 μm.

The invention can further provide a method for producing a shoe press belt for paper-making machine on a mandrel (rotary cylinder), when said belt in an endless form whose shoe contact surface is constituted of a polymer elastic part was produced using the surface of mandrel, characterized by controlling, polishing or engraving in pattern said mandrel so that a surface roughness of the shoe contact surface of said shoe press belt for paper-making machine is Ra=1.0 to 3.5 μm, and impressing said shoe contact surface with the surface roughness.

ADVANTAGES OF THE INVENTION

According to the invention, a rough surface having irregularities whose surface roughness is Ra=1.0 to 3.5 μm is formed at the shoe contact surface of the shoe press belt for paper-making machine, and for the rough surface can held a lubricant, lager amount of lubricant can be supplied between the belt and the shoe.

As a result, a sufficient amount of lubricant is supplied between the belt and the shoe, and thus heat of friction between the belt and the shoe can be suppressed to prevent the belt from being damaged.

Further, even if a shortage of lubricant at the contact surface between the shoe and the belt takes place because of no supply of lubricant resulting from the trouble of a lubricant supply device, the frictional resistance can be suppressed by means of the irregularities of the shoe contact surface, thereby enabling the damage of the belt to suppressed to minimum.

EXPLANATION OF REFERENCE SYMBOLS

1: Belt
1*a*: Shoe contact surface
1*b*: Wet paper contact surface
2: Base member
3: Polymer elastic part
21: Woven fabric
21*a*: Forward end of woven fabric
21*b*: Rear end of woven fabric
C: Coater bar
M: Mandrel
N: Nozzle
R: Press roll
S: Shoe
AC: Air cylinder
PE: Press terminal
BS: Belt sample
SH: Sample fixing base

BEST MODE FOR CARRYING OUT THE INVENTION

Figure 1:
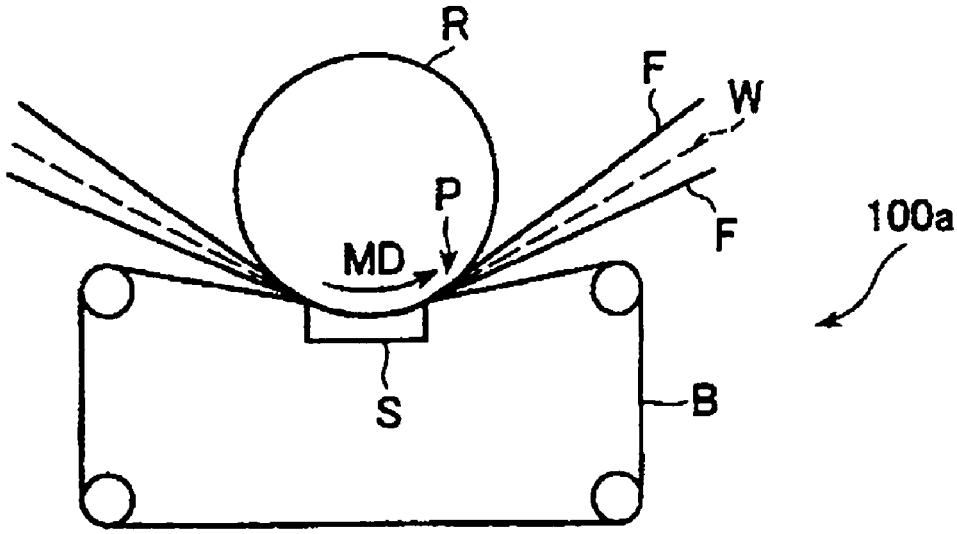
FIG. 1 A schematic view of a conventional shoe press device used in a press part.
Figure 1:
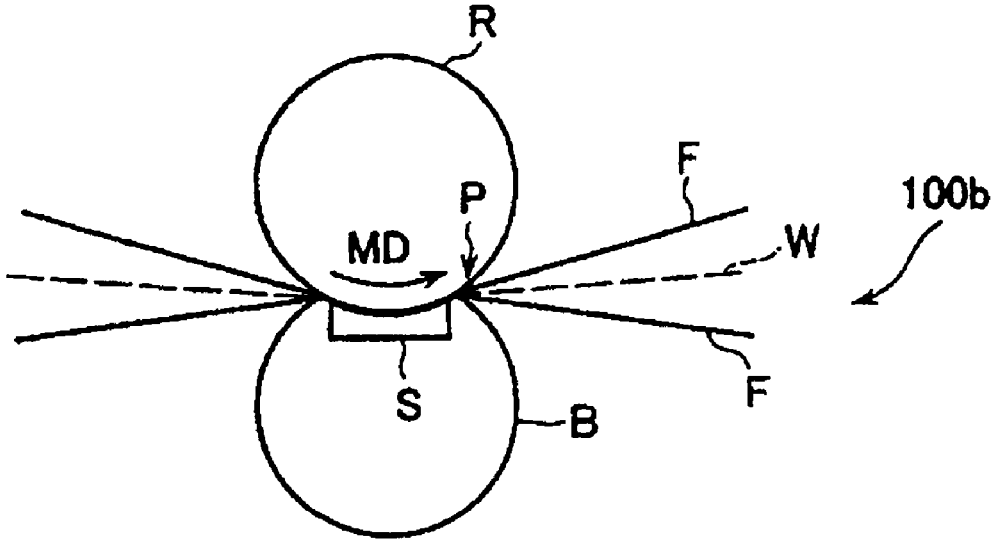
Figure 2:
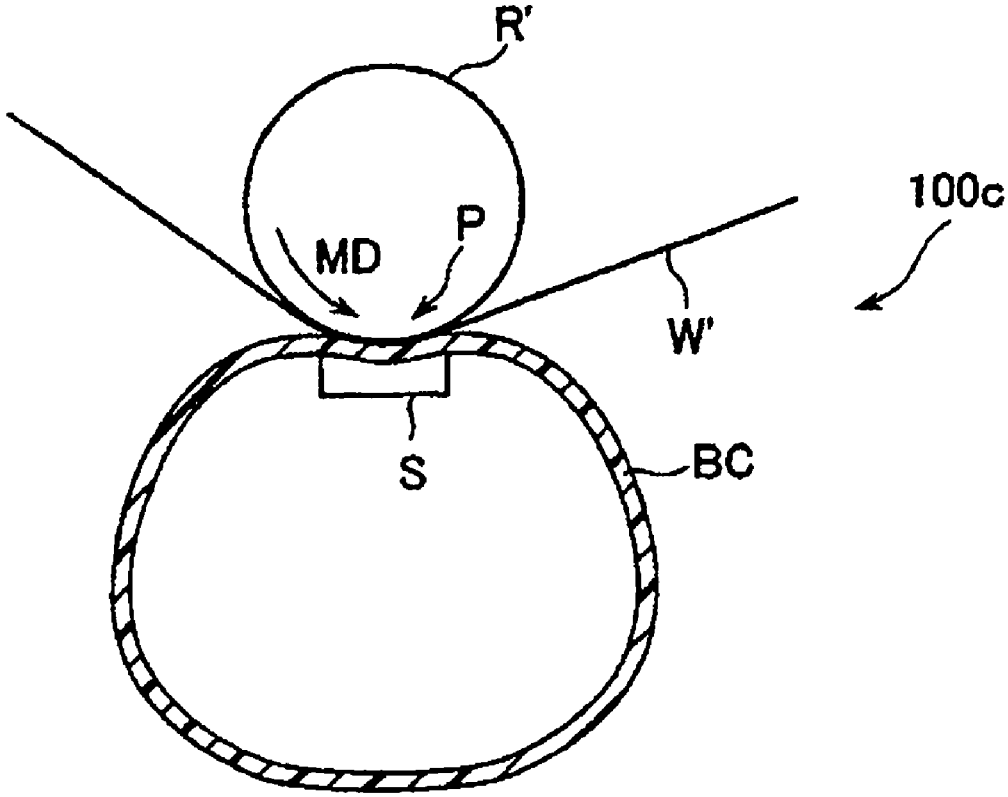
FIG. 2 A schematic view of a conventional shoe press device used in a calendar part.
Figure 3:
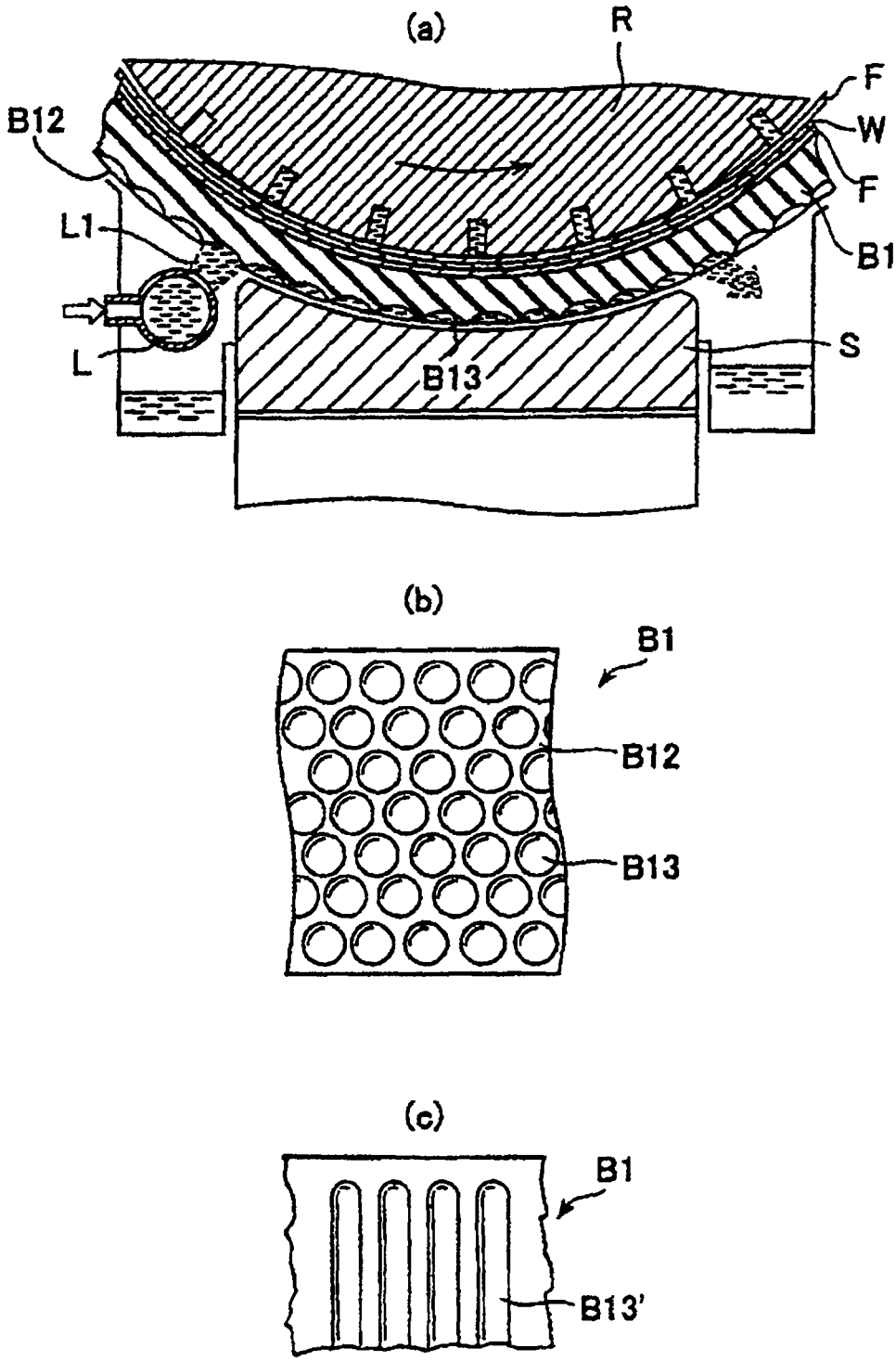
FIG. 3 An illustrative view of a conventional art for supplying a lubricant between shoe and belt.
Figure 4:
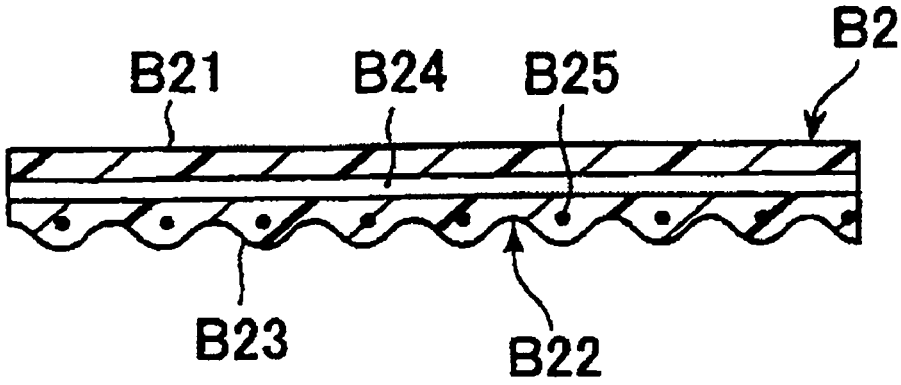
FIG. 4 An illustrative view of a conventional art for supplying a lubricant between shoe and belt.
Figure 5:
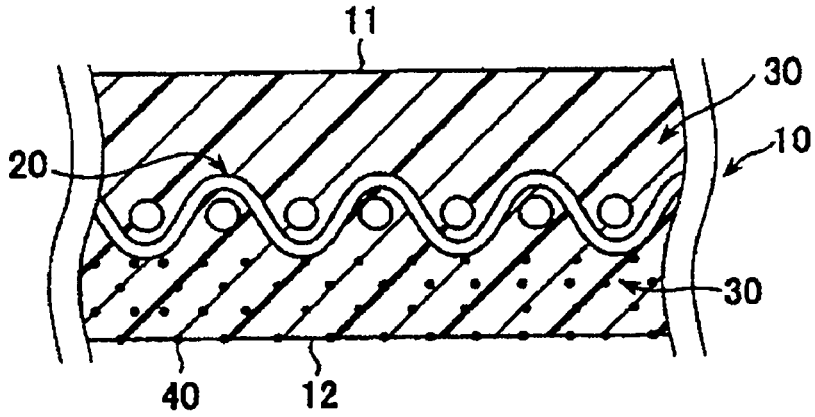
FIG. 5 An illustrative view of a conventional art for supplying a lubricant between shoe and belt.
Figure 6:
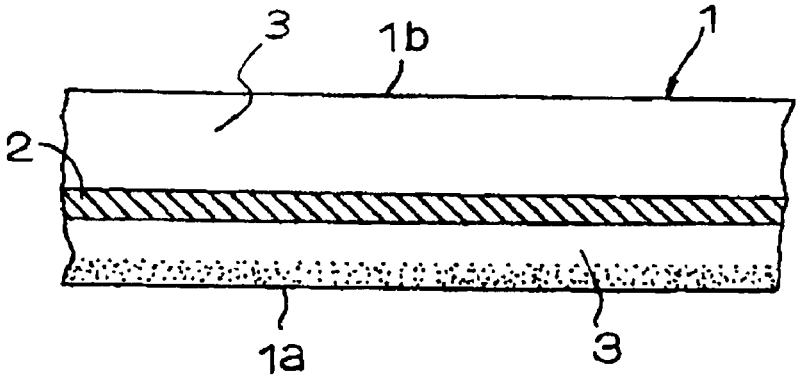
FIG. 6 A sectional view of a shoe press belt for paper-making machine according to the invention.

An embodiment of a shoe press belt for paper-making machine according to the invention is illustrated based on FIG. 6. A belt 1 is constituted of a base member 2 and a polymer elastic part 3 and has a wet paper contact surface 1*b* and a shoe contact surface 1*a*.

The base member 2 is provided to develop strength of the belt, and a base woven of MD yarns and CMD yarns is preferably used therefor. Without being limited to this instance, however, there may be conveniently used those serving to function as a base member, including a stacked one of MD yarns and a CMD yarns without weaved, an endless cloth wherein an elongated band-shaped cloth is spirally wound, and the like.

FIG. 6 shows an instance that the polymer elastic parts 3 are formed on both sides of the base member 2. In this case, the polymer elastic part 3 is also formed at interstices of the yarns in the base member 2.

The polymer elastic part 3 consists of a polyurethane elastomer having a hardness of 80 to 99° (JIS-A) and etc.

The shoe contact surface 1*a* is inevitably consisted of polymer elastic member 3, in both uses of the shoe-press belt for paper-making machine of the invention, regardless of the cases that grooves (not shown) for transiently holding moisture from wet paper are formed at the polymer elastic part 3 of the wet paper contact surface 1*b*, or that no polymer elastic member 3 is formed at the wet paper contact surface 1*b* and one side of the base member 2 forms the wet paper contact surface 1*b* of the belt 1 as an inherent arrangement of shoe press belt.

Rough surface are formed at the shoe contact surface 1*a*. Although a surface at which fine irregularities are randomly formed can be preferably used as the rough surface, fine lattice-shaped grooves (not shown) may be also formed. In FIG. 6, the rough surface in the shoe contact surface 1*a* is schematically exaggerated in the form of a spot pattern.

In the present invention, a lubricant is held in the formed rough surface, i.e. in the fine irregularities or fine lattice-shaped grooves, so that a larger amount of lubricant can be supplied between the shoe and the belt 1.

Further, as the polymer elastic body at the shoe side of the belt 1 has a reduced area contacting with the shoe, an abrupt increase of frictional resistance is prevented, even when the lubricant becomes short.

In the present invention, the polymer elastic part 3 serving as the shoe contact surface 1*a*, whose the surface roughness is Ra=1.0 to 3.5 μm, is preferably used. If the surface roughness Ra is less than 1.0 μm, the function of holding a lubricant at the rough surface lowers and thus, the lubricant supplied between the belt and the shoe becomes short. Moreover, when a lubricant is not present, an abrupt increase of frictional resistance takes place owing to the great area contacting the shoe at the shoe side of the polymer elastic part. Except for belt running conditions, e.g. when a belt is mounted in a machine, a method of moving a belt to position by sliding over a mounting device and the shoe are adopted in a lubricant-free condition. In this case, when the surface roughness Ra is less than 1.0 μm, there arises a problem in that a great frictional resistance is occurred for contacting a great area of the polymer elastic member at the shoe side of the belt 1 with the shoe, and the frictional resistance makes the mounting movement difficult. When the surface roughness exceeds 3.5 μm, the function of holding a lubricant in the rough surface, particularly in concave portions, is kept. Nevertheless, the frictional resistance as a whole of the belt increases, for the lubricant to be prevented from intruding into the convex portions of the rough surface.

Next, an instance of a process of producing the belt 1 of the invention is generally described.

Figure 7:
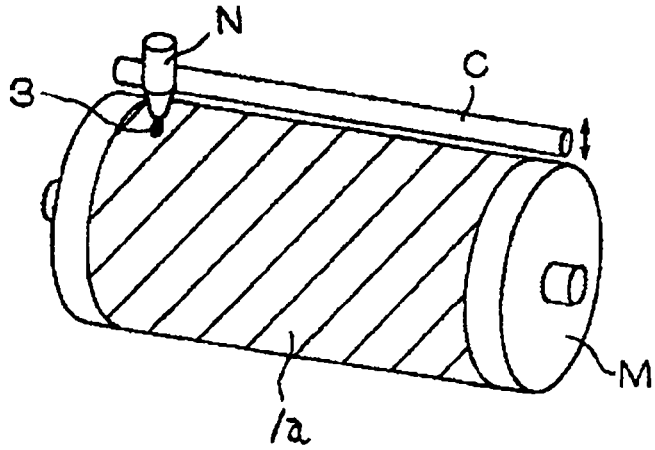
FIG. 7 A perspective view showing a process for producing a shoe press belt for paper-making machine according to the invention.

In FIG. 7, M indicates a mandrel, C indicates a coater bar and N indicates a nozzle. The mandrel M has a diameter corresponding to the diameter of the belt 1 and is rotatably designed. The nozzle N is arranged to be movable along the longitudinal direction of the mandrel M. The nozzle N is connected to a storage tank (not shown) of a polymer elastic material. The coater bar C is arranged to be finely movable along vertical directions and works to uniformly control the thickness of the polymer elastic material applied by means of the nozzle N.

The belt 1 of the invention is produced by use of the surface of the mandrel M and for the production, the mandrel M is initially roughened at a hatched portion shown in FIG. 7 by polishing means such as a sand paper or sand blasting so that the surface roughness is at Ra=1 to 5 μm. Alternatively, a lattice-shaped mesh may be placed to cover the mandrel M entirely, or a lattice-shaped concavo-convex pattern may be engraved in the mandrel surface.

Figure 8:
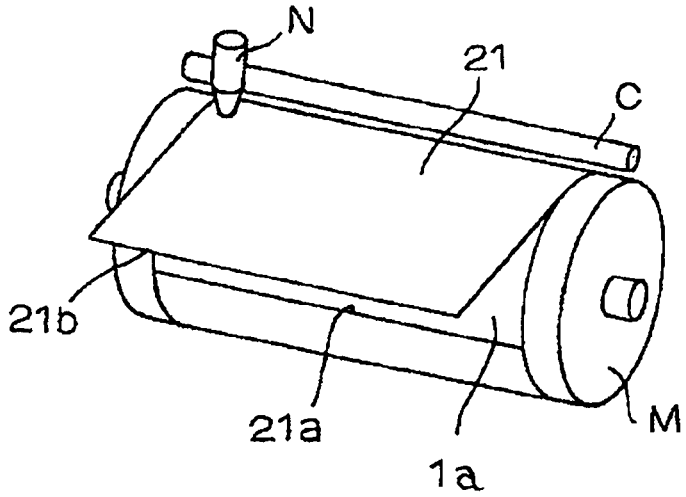
FIG. 8 A perspective view showing a process for producing a shoe press belt for paper-making machine according to the invention.

Next, a polymer elastic material is coated from the upper side of the mandrel M by means of the nozzle N. Thereafter, the resulting polymer elastic part 3 formed by the coating is semi-cured by allowing it to stand or by a heating device (not shown). This polymer elastic part 3 eventually forms the shoe contact surface 1*a* of the belt 1 of the invention. After the semi-curing, a woven cloth 21 serving as a base member 2 is wound about the surface side of the polymer elastic part 3 as shown in FIG. 8, and the woven cloth 21 is cut off at the same position as a tip portion 21*a* to provide a rear end 21*b*, and both ends 21*a*, 21*b* are abutted with each other.

Thereafter, a thread, woven cloth or lattice-shaped fiber material for reinforcement is wound therearound.

Figure 9:
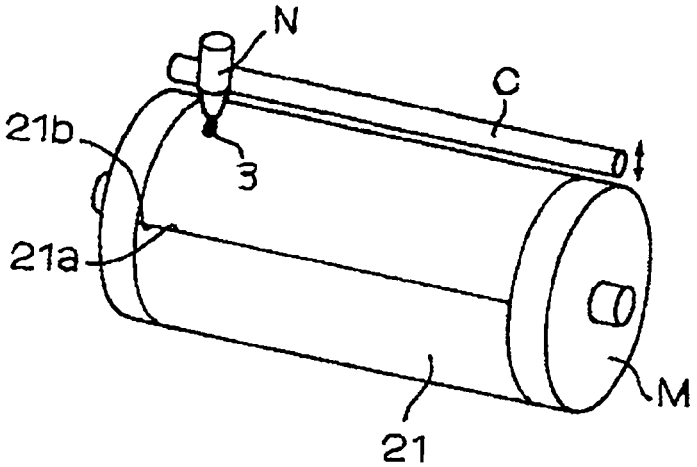
FIG. 9 A perspective view showing a process for producing a shoe press belt for paper-making machine according to the invention.

Next, as shown in FIG. 9, a polymer elastic material is coated by means of the nozzle N. The polymer elastic material is filled in voids of the MD yarns and the CMD yarns of the woven cloth 21, and forms a wet paper contact surface 1*b*, and is subsequently cured by allowing it to stand or by heating means not shown.

The polymer elastic parts 3 may be provided as the same type of polymer elastic part or a different type of polymer elastic part, depending on the characteristics of the belt 1 of the invention. After the polymer elastic part 3 constituting the belt of the invention has been cured, the wet paper contact surface 1*b* is surface-polished to a desired thickness and to be smoothed. If necessary, drainage grooves may be formed in the surface by means of a grooving device (not shown). Thereafter, removal from the mandrel M arrives at completion of the belt 1 of the invention. When a lattice-shaped mesh is placed on the mandrel M beforehand, a choice of a mesh, whose release properties are excellent, permits easy separation of the mesh alone in the removal of the belt of the invention from the mandrel M.

Next, the functions and the effects of the belt 1 of the invention are now described.

Because a polymer elastic material is coated onto a roughened surface-bearing mandrel in the formation of the shoe contact surface 1*a* of the belt 1 of the invention, the resulting shoe contact surface 1*a* of the belt 1 becomes roughened. More particularly, the surface irregularities of the mandrel are impressed in the shoe contact surface of the belt of the invention, and the surface is randomly formed with fine irregularities.

As a result of experiments in the invention, it has been confirmed that the surface roughness of the shoe contact surface 1*a* is preferably Ra=1.0 to 3.5 μm. The surface roughness Ra used herein is based on a measuring method of a center line average roughness defined in JIS B0601-1982.

The measurement is carried out by use of a contact needle having a tip radius of 5 μm under conditions of a measuring length of 10 mm, a trace velocity of 0.6 mm/s and a cutoff value of 1.6 mm.

To achieve the surface roughness within this range the roughing of the mandrel M is needed. In the invention, it is preferred to roughen the mandrel surface by polishing with a polishing material so that the surface roughness of the mandrel M is within a range of Ra=1 to 5 μm.

Alternatively, the mandrel M may be covered with a fine lattice-shaped mesh, or may be engraved in lattice shape in the surface thereof.

The polishing material used may be a polishing material such as a buff, a disc or a grinder, or a grinding stone. As the polishing material, there may be used a single polishing material or a plurality of polishing materials.

The lattice-shaped mesh used may include a cloth, a wire mesh or a non-woven fabric made of Teflon (registered trademark).

EXAMPLES

Figures 10, 11:
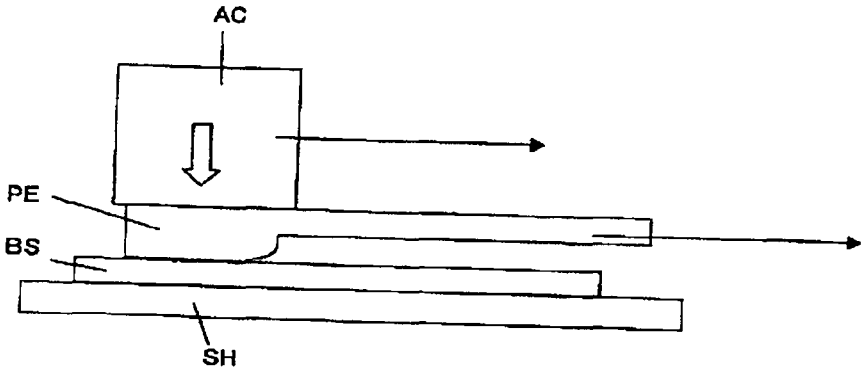
FIG. 10 A schematic view of a device for testing the performance of a shoe press belt for paper-making machine of an example.
FIG. 11 A table showing the results of the test using the device of FIG. 10.

The shoe press belts for paper-making machine according to the invention were tested to confirm the effect thereof by use of a device shown in FIG. 10.

Initially, samples were provided as used in Examples. All the samples were made according to the following steps.

Step 1: A mandrel having dimensions including a diameter of 50 cm and a longitudinal direction length of 50 cm was provided. The mandrel had a surface roughness of Ra=0.45 μm prior to polishing.

Next, the surface of the mandrel was finished to have such surface roughnesses as indicated in FIG. 11 by means of a polishing material using aluminum oxide as an abrading material.

Step 2: Takenate L2395 (commercial name), made by Mitsui Chemicals Polyurethanes, Inc., was provided as a prepolymer. Ethacure 300 (commercial name), made by Albemarle Corporation, was provided as a curing agent. These were mixed together to obtain a thermocurable liquid urethane (polymer elastic material).

While rotating the mandrel, the thermocurable liquid urethane was coated onto the mandrel from a nozzle, thereby forming an inner peripheral face having a shoe contact surface of a belt.

Step 3: An open-ended woven fabric woven of MD yarns and CMD yarns was provided as a base member. Polyester multifilaments were used as the MD yarn and CMD yarn, respectively.

The base member was spirally wound about the inner peripheral surface and was completed by fixing at both ends.

Step 4: The thermocurable liquid urethane of step 2 was allowed to impregnate to an intermediate position of the woven fabric of step 3. Moreover, the thermocurable liquid urethane not only filled in the woven fabric at areas above the intermediate position, but also was built up over the upper surface of the woven fabric, followed by curing to form an outer peripheral surface of the belt including a wet paper contact surface.

Step 5: The urethane portion at the outer peripheral surface was polished to obtain a 5 mm thick sample.

The samples obtained by the steps were tested by use of a test device shown in FIG. 10. A sample BS was fixed on a sample holder SH so that the shoe contact surface was turned up. A metal pressing end PE was placed thereon, followed by applying, from thereon, compression pressure by means of an air cylinder AC. In this condition, the pressing end PE was horizontally drawn, whereupon a force exerted on the pressing end PE was measured by means of a load cell. The air cylinder AC was so designed as to move in synchronism with the pressing end PE, so that only a frictional resistance between the pressing end PE and the sample BS could be measured. The frictional resistance measured was a dynamic friction resistance. The test was conducted by two ways including a condition (test 1) where no lubricant was applied onto the shoe contact surface of the sample BS and a condition (test 2) where a lubricant was lightly applied onto the shoe contact surface of the sample BS.

The test conditions are as indicated below.

Pressure exerted on the pressing end: 80 kg/cm$^2$

Pulling speed of pressing end: 180 cm/minute

Room temperature on testing: 25° C.

Lubricant: Super Mulpus 150, made by Nippon Oil Corporation

The results of the experiment are shown in FIG. 11.

As a result, when the surface roughness of the samples was at Ra=1.0 to 3.5 μm, the frictional resistance lowered irrespective of the presence or absence of the lubricant at the shoe contact surface.

With those having less than Ra=1.0 μm, if no lubricant is used, the frictional resistance abruptly increased. Even when the lubricant was used, a high frictional resistance was shown.

With those exceeding Ra=3.5 μm, the frictional resistance in the absence of the lubricant was at a similar level as those having Ra=1.0 to 3.5 μm, but no further effect was observed. The use of the lubricant resulted in an increased frictional resistance.

The invention claimed is:

1. A shoe press belt for paper-making machine, said shoe press belt having a wet paper contact surface and a shoe contact surface, wherein said shoe press belt comprises a base member, and a polymer elastic part comprising said shoe contact surface, wherein a surface roughness of the shoe contact surface of the polymer elastic part is Ra=1.0 to 2.98 μm.

2. The shoe press belt according to claim 1, wherein the polymer elastic part comprises a polyurethane elastomer having a hardness of 80 to 99°.

3. The shoe press belt according to claim 1, wherein the polymer plastic part is formed on both sides of the base member.

4. The shoe press belt according to claim 3, wherein the wet paper contact surface of the polymer elastic part contains grooves.

5. The shoe press belt according to claim 1, which contains no polymer elastic member formed at the wet paper contact surface side of the base member.

6. The shoe press belt according to claim 1, wherein lubricant is held in the shoe contact surface of the polymer elastic part.

7. A method for producing a shoe press belt for paper-making machine on a mandrel (rotary cylinder), comprising controlling, polishing or engraving in pattern said mandrel so that a surface roughness of the shoe contact surface of said shoe press belt is Ra=1.0 to 2.98 μm, and impressing said shoe contact surface by forming an inner peripheral face having a shoe contact surface of the shoe press belt on the mandrel.

8. In a paper-making machine comprising a shoe press belt having a wet paper contact surface and a shoe contact surface, the improvement comprising using a shoe press belt comprising a base member, and a polymer elastic part comprising said shoe contact surface, wherein a surface roughness of the shoe contact surface of the polymer elastic part is Ra=1.0 to 2.98 μm.

* * * * *